United States Patent [19]

Myers et al.

[11] 4,342,969

[45] Aug. 3, 1982

[54] MEANS FOR MATCHING IMPEDANCES BETWEEN A HELICAL RESONATOR AND A CIRCUIT CONNECTED THERETO

[75] Inventors: Richard T. Myers; David L. Roberson, both of Lynchburg, Va.

[73] Assignee: General Electric Company, Lynchburg, Va.

[21] Appl. No.: 194,681

[22] Filed: Oct. 6, 1980

[51] Int. Cl.[3] ..... H01P 5/02; H01P 7/00

[52] U.S. Cl. ..... 333/33; 333/219; 333/238

[58] Field of Search ..... 333/33, 263, 219, 222, 333/230, 224, 226, 202

[56] References Cited

U.S. PATENT DOCUMENTS

| | | | |
|---|---|---|---|
| 2,041,378 | 5/1936 | Smith | 333/33 |
| 2,446,982 | 8/1948 | Pound | 333/33 X |
| 2,794,174 | 5/1957 | Ardibi et al. . | |
| 2,938,175 | 5/1960 | Sommers et al. . | |
| 3,003,126 | 10/1961 | Jasik . | |
| 3,400,295 | 9/1968 | Chapell . | |
| 3,621,484 | 11/1971 | Shult | 333/202 |
| 3,764,942 | 10/1973 | Keim et al. . | |

*Primary Examiner*—Paul L. Gensler

*Attorney, Agent, or Firm*—James J. Williams

[57] ABSTRACT

Impedance matching between a helical resonator of a helical resonator filter and a circuit connected thereto is accomplished by the provision of a microstrip transmission line including a microstrip stub printed on a printed circuit board, the microstrip stub being short in comparison to the wavelength at the resonant frequency of the filter whereby the microstrip stub assumes the characteristics of an inductive impedance. A first electrical end of the microstrip stub is connected to a first terminal of the helical resonator and to a first terminal of the circuit, and a second electrical end of the microstrip stub is connected to a second terminal of the helical resonator and to a second terminal of the circuit.

6 Claims, 4 Drawing Figures

18b
$R_R$
$X_R$
37
18
25ℓ
25
25a
27
28a
28b
$X_S$
$R_S$
+
−
$V_S$
28

18b
$R_R$
$X_R$
37
18
$X_{EQ}$
$R_{EQ}$
+
−
$V_{EQ}$

MEANS FOR MATCHING IMPEDANCES BETWEEN A HELICAL RESONATOR AND A CIRCUIT CONNECTED THERETO

FIELD OF THE INVENTION

This invention relates to the printed circuit board art and particularly to new and improved means for providing impedance matching between a helical resonator of a printed circuit board mounted helical resonator filter and a circuit connected thereto.

BACKGROUND OF THE INVENTION

A helical resonator filter, mounted on a printed circuit board and providing filtering for signals at hundreds of megahertz, typically comprises an input helical resonator having a helical winding and a series capacitive region and an output helical resonator having a helical winding and a series capacitive region. A conductive cover also mounted on the circuit board encloses both resonators and permits signal transfer from the input to the output resonator by means of inductive and capacitive coupling. Impedance matching between such an input or output helical resonator and a circuit connected thereto, some elements of which may be printed on the circuit board, has been achieved in the prior art by providing means for tapping the helical winding of the helical resonator. However, with such means the helical winding cannot be tapped at a precise point whereby attainment of optimum impedance matching is especially difficult.

OBJECTS OF THE INVENTION

Accordingly, it is a primary object of the present invention to provide new and improved means for attaining impedance matching between a helical resonator and a circuit connected thereto whereby optimum impedance matching is facilitated.

Another object of the present invention is to provide new and improved means for attaining optimum impedance matching between a helical resonator and a circuit connected thereto which means is implemented with relatively inexpensive printed circuit board techniques.

SUMMARY OF THE INVENTION

In carrying out the objects of this invention in one form, a network for a printed circuit board having an insulative base includes a helical resonator having both a helical winding and a series capacitive region and a cooperating electrical circuit. To attain impedance matching between the helical resonator and the circuit, there is provided a section of microstrip transmission line including a planar microstrip stub printed on the printed circuit board and having a relatively short electrical length compared to the wavelength at the resonant frequency of the helical resonator, whereby the microstrip stub assumes the characteristics of an inductive impedance at the resonant frequency of the helical resonator. Means are provided for electrically interconnecting a first terminal of the helical resonator, a first terminal of the circuit, and a first electrical end of the microstrip stub. Further means are provided for electrically interconnecting a second terminal of the helical resonator, a second terminal of the circuit, and a second electrical end of the microstrip stub. In circuit operation the helical resonator thus "sees" an effective series impedance which is equivalent to the parallel combination of the impedance of the circuit and the impedance of the microstrip stub. The inductive impedance value of the microstrip stub is preselected or chosen to provide an effective series impedance equivalent to the complex conjugate of the impedance of the helical resonator thereby to attain optimum impedance matching between the helical resonator and the circuit. The inductive impedance value of the microstrip stub, in turn, depends upon the length, width, and thickness thereof and the stub configuration, all of which are preselected in accordance with the thickness and the dielectric constant of the insulative base of the printed circuit board.

The invention will be better understood and its various objects and advantages will be more fully appreciated from the following description taken in conjunction with the accompanying drawing.

DETAILED DESCRIPTION

Figure 1:
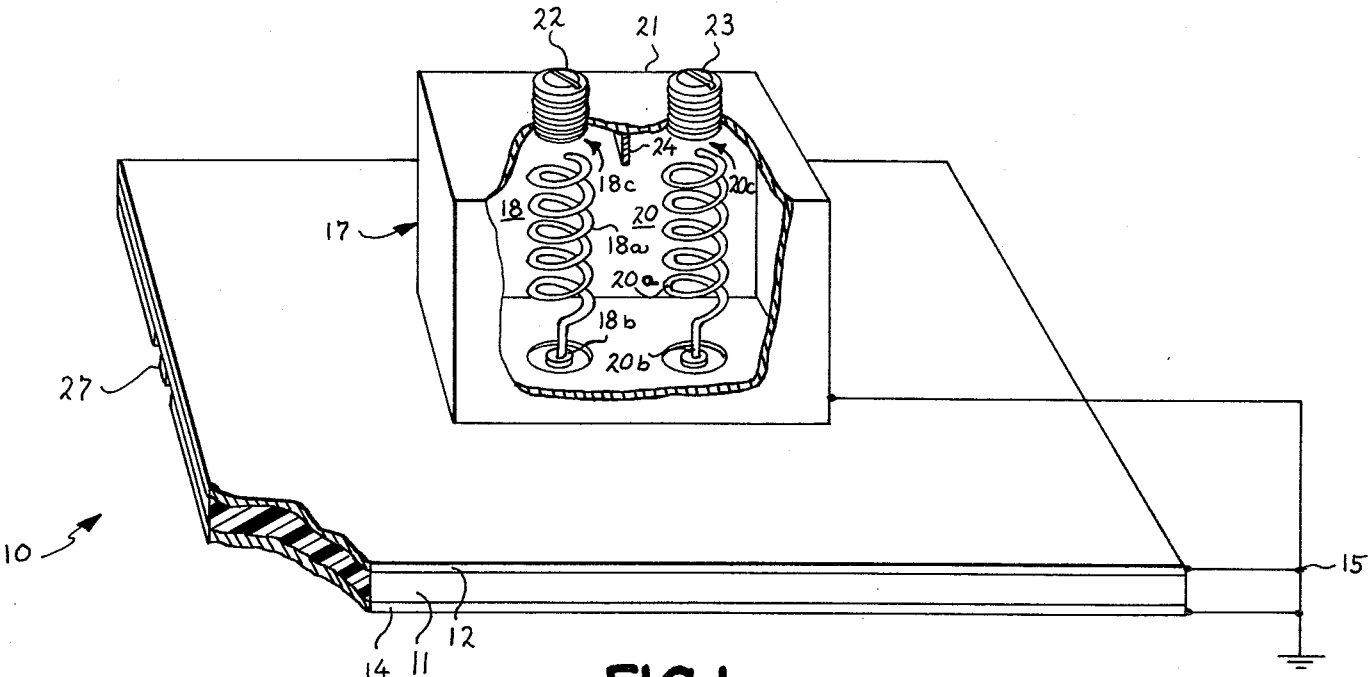
FIG. 1 is an enlarged perspective view of a printed circuit board having a helical resonator filter and a conductive filter cover mounted thereon with the cover partially broken away to facilitate viewing of input and output helical resonators contained therein.

Referring to FIG. 1, there is shown a printed circuit board generally designated 10 and comprising a planar insulative base 11, an upper ground plane 12, and a lower ground plane 14, the ground planes 12 and 14 being electrically interconnected as indicated at 15 and also constituting a common electrical connection shown as ground. Suitably mounted on the printed circuit board 10 is a helical resonator filter generally designated 17 comprising a pair of cooperating input and output helical resonators 18 and 20. A conductive cover 21 rests on the upper ground plane 12, houses the input and output resonators 18 and 20 and is electrically connected to both ground planes 12 and 14 as also indicated at 15.

Within the helical resonator filter cover 21, the input resonator 18 comprises a helical winding **18*a* which may be provided with an insulative structural support (not shown). A lower terminal 18*b* of the winding 18*a* extends through an aperture to the lower side of the printed circuit board 10. The resonator 18 further includes a series capacitive region 18*c* formed between the upper end of the helical winding 18*a* and the lower face of a grounded tuning screw 22 which cooperate as capacitive electrodes and define a capacitive dielectric air gap therebetween. The screw 22 is threadably mounted in the top of the cover 21. The output helical resonator 20 likewise comprises a helical winding 20*a* which may be provided with an insulative structural support (not shown). A lower terminal 20b of the winding 20a also extends through an aperture to the lower side of the printed circuit board 10. The resonator 20 likewise further comprises a capacitive region 20c positioned between the lower face of a grounded tuning screw 23 and the upper portion of the helical winding 20a, thereby also providing capacitive electrodes and defining a capacitive dielectric air gap. The screw 23 is also threadably mounted in the top of the cover 21**.

The cover 21 includes an internal wall section 24 located between the input and output helical resonators 18 and 20, which wall section 24 defines a port permitting signal propagation from the input resonator 18 to the output resonator 20 by means of inductive and capacitive coupling therebetween.

Figure 2:
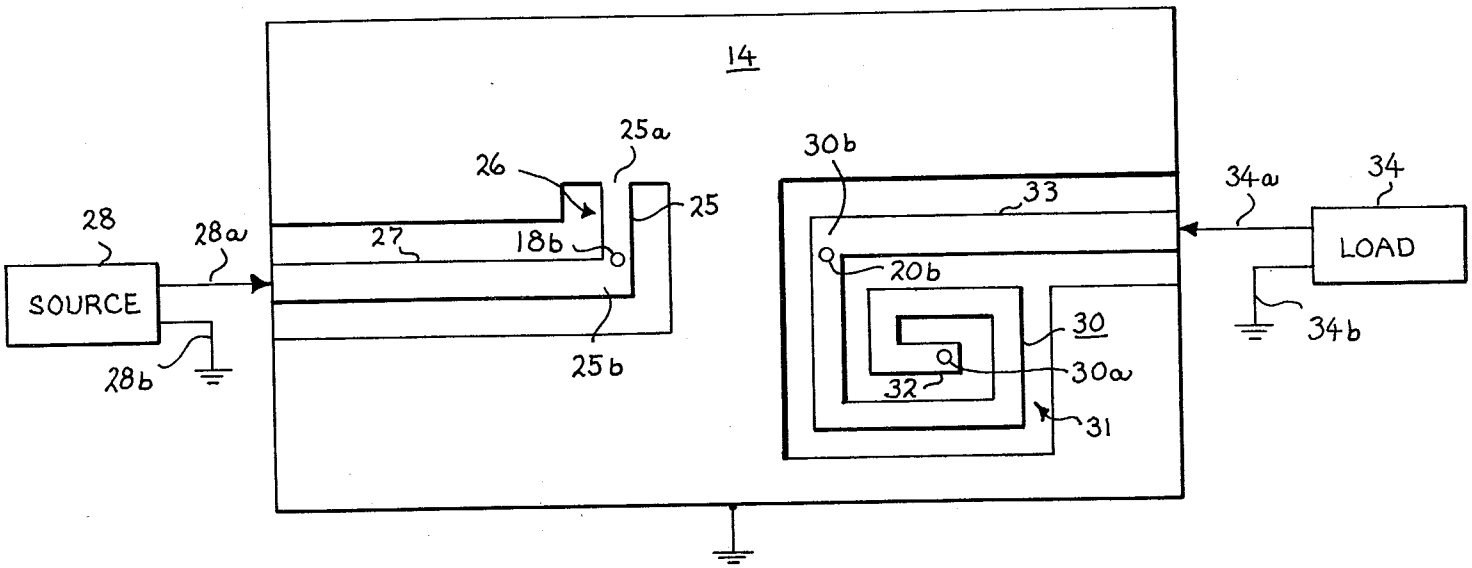
FIG. 2 is an enlarged bottom plan view of the printed circuit board of FIG. 1 illustrating printed circuit elements of the present invention and source and load circuits in block form connected, respectively, to the input and output helical resonators which are mounted on the upper side of the board.

Referring to FIG. 2, there is shown a rectangular and planar metallic microstrip stub 25 printed on the underside or opposite side of the printed circuit board 10 with respect to the upper ground plane 12 shown in FIG. 1. The upper ground plane 12 has a relatively large surface area opposite the stub 25, and the ground plane 12 and the stub 25 cooperate to define a microstrip transmission line generally designated 26. The stub 25 is formed by removing portions of the ground plane 14, and all remaining metal or conductive surfaces are shaded to clarify the invention. The stub 25 has a first electrical end 25a integral with, and thus connected to, the ground plane 14, and a second electrical end 25b connected to the lower terminal 18b of the input helical resonator 18. These first and second electrical ends 25a, 25b of the stub 25 define a predetermined electrical length therebetween. The second electrical end 25b of the stub 25 is connected also to terminal 28a of a source circuit 28 through a printed circuit board conductor 27 of any suitable configuration. The source circuit 28 has another terminal 28b which is grounded. The source circuit 28 has an internal impedance at least partially resistive, and the stub 25 has an inductive impedance value preselected to attain impedance matching between the helical resonator 18 and the source circuit 28.

As will be understood by those skilled in the art, the microstrip stub 25 has a characteristic impedance depending upon the width and thickness thereof, and the thickness and the dielectric constant of the printed circuit board insulative base 11. The electrical length of the grounded or short-circuited microstrip stub 25 is shorter than one-quarter wavelength at the resonant frequency of the input helical resonator 18, whereby in operation the stub 25 assumes the characteristics of an inductive impedance. As will also be understood by those skilled in the art, the electrical length of the stub 25 determines the inductive impedance value thereof, once its characteristic impedance has been determined. A lower limit on the electrical length of the stub 25 results from the practical consideration of implementing a very low impedance value for the stub 25, and an upper limit on this electrical length results from the undesirably very high impedance present in the stub 25 when the electrical length thereof approaches one-quarter wavelength at the resonant frequency of the helical resonator 18.

Shown also in FIG. 2 is an elongated, coiled and planar microstrip stub 30 printed on the underside or opposite side of the printed circuit board 10 with respect to the upper ground plane 12 shown in FIG. 1. The upper ground plane 12 has a relatively large surface opposite the stub 30, and the ground plane 12 and the stub 30 cooperate to define a microstrip transmission line generally designated 31. The stub 30 is provided with the coiled configuration, or configuration wherein the stub 30 is bent upon itself a multiplicity of times, in order to conserve the space occupied thereby on the printed circuit board 10. Space considerations are apt to be especially important where the helical resonator filter 17 has a relatively low resonant frequency whereby the wavelength, and thus the electrical length of the stub 30 necessary to attain a given impedance value, is relatively long. A first electrical end 30a of the microstrip stub 30 is connected to a means 32 for making electrical contact with the upper ground plane 12 and a second electrical end 30b of the stub 30 is connected to the output helical resonator lower terminal 20b. The first and second electrical ends 30a, 30b of the stub 30 define an electrical length therebetween. The second electrical end 30b of the stub 30 is connected also to terminal 34a of a load circuit 34 through a printed circuit board conductor 33 of any suitable configuration. The load circuit 34 has another terminal 34b which is grounded and has an impedance at least partially resistive.

As with the microstrip stub 25, the characteristic impedance of the microstrip stub 30 depends upon the width and thickness thereof and the thickness and the dielectric constant of the printed circuit board insulative base 11. However, for a given resonant frequency of the output helical resonator 20 and characteristic impedance of the stub 30, the electrical length thereof considered alone does not determine the impedance value of the stub 30. The effect of mutual inductance must be considered, owing to the proximity of sections of the stub 30 with adjacent sections thereof whereby mutual inductive coupling can occur.

Figure 3A:
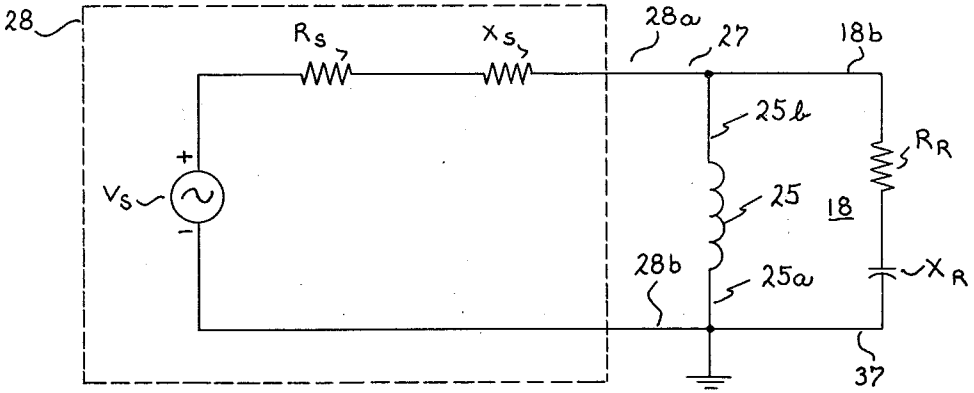
FIG. 3A is a circuit diagram representing an input network of a helical resonator filter incorporating a microstrip stub in accordance with the present invention.

Referring to FIG. 3A, to facilitate explanation of the impedance matching function performed by the microstrip stub 25, there is shown one equivalent circuit diagram for the input network including the input helical resonator 18, the source circuit 28, and the stub 25. Inasmuch as the output network including the output helical resonator 20, the load circuit 34 and the microstrip stub 30 can be represented by essentially the same circuit diagram as for the input network except for the deletion of the voltage source $V_S$, a detailed explanation of the impedance matching function performed by the stub 30 is not herein provided.

Figure 3B:
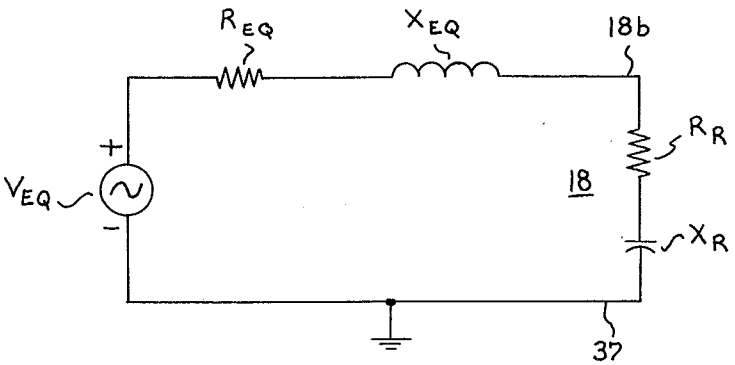
FIG. 3B is an electrically equivalent circuit diagram to facilitate explanation and understanding of the circuit illustrated in FIG. 3A.

The source circuit 28 is represented as an ideal voltage source $V_S$ in series with an internal series resistance $R_S$ and any internal series reactance $X_S$; the stub 25 is represented as an inductive impedance; and the input helical resonator 18 is represented as a series resistance $R_R$ and a series net capacitive reactance $X_R$. The first or grounded electrical end 25a of the stub 25 is connected to the source circuit terminal 28b and to the grounded terminal of the resonator 18 through means 37. The second electrical end 25b of the stub 25 is connected to the source circuit 28 through terminal 28a and to the resonator 18 through the resonator lower terminal 18b. An equivalent series circuit to the left of the terminal 18b and the means 37 can be determined, for example, by THEVININ'S theorem, and such an equivalent circuit is shown in FIG. 3B. In this circuit, a resistance $R_{EQ}$ and a series reactance $X_{EQ}$ are equivalent to the parallel combination of the inductive impedance of the stub 25 and the internal series impedances $R_S$ and $X_S$ of the source circuit 28. Impedance matching is optimally attained when the resistance $R_{EQ}$ is equivalent to the resistance $R_R$ and the reactance $X_{EQ}$ is equivalent to the negative of the reactance $X_R$. In other words, matching is obtained when the series impedance $R_{EQ}$ and $X_{EQ}$ is equivalent to the complex conjugate of the series impedance $R_R$ and $X_R$ of the resonator 18. From this relation, the value of inductive impedance of the stub 25 needed to attain impedance matching can be determined.

By way of example, if an inductive impedance value of 15 ohms at 477.6 megahertz for a rectangular microstrip stub 25 is necessary to attain impedance matching, and if it is desired to use a printed circuit board 10 including an insulative base 11 of approximately 0.059 inch thickness and a dielectric constant of approximately 4.6, typical approximate dimensions for the microstrip stub 25 are as follows: length 0.64 inch; width 0.1 inch; and thickness 0.0014 inch. It will be understood by those skilled in the art that the selection of typical dimensions for a coiled microstrip stub 30 to implement an impedance value necessary to attain impedance matching must additionally take into account any mutual inductance effects.

While the present invention has been described in relation to specific implementations, modifications will occur to those skilled in the art. For example, it is to be understood from the foregoing that the microstrip stubs 25 and 30 can be interchangeably used in input or output networks of the helical resonator filter 17. Additionally, a microstrip stub could be placed on the side of the printed circuit board 10 upon which the helical resonator filter is situated. All such modifications are considered to fall within the spirit and scope of the invention as defined in the appended claims.

What we claim as new and desire to secure by Letters Patent of the United States is:

1. In a network for a printed circuit board having an insulative base and including a helical resonator and a cooperating electrical circuit, means for providing impedance matching between said helical resonator and said circuit, comprising:

a. a microstrip transmission line including a microstrip stub printed on said base;

b. means electrically interconnecting a first terminal of a helical resonator, a first terminal of said circuit, and a first electrical end of said microstrip stub;

c. means electrically interconnecting a second terminal of said helical resonator, a second terminal of said circuit, and a second electrical end of said microstrip stub; and d. said microstrip stub being of an electrical length less than one-quarter wavelength at the resonator frequency of said helical resonator for constituting an inductive impedance, and having overall dimensions and being of a configuration preselected in accordance with the thickness and dielectric constant of said insulative base to provide a predetermined inductive impedance value for said microstrip stub at the resonant frequency of said helical resonator whereby said impedance matching is attained.

2. The network defined in claim 1, wherein said microstrip stub is planar.

3. The network defined in claim 1 or claim 2, wherein said microstrip stub is elongated and is bent upon itself to conserve the space occupied thereby.

4. The network defined in claim 3, wherein said microstrip stub includes a coiled section.

5. An improved printed circuit board arrangement comprising:

a. an insulative base having conducting ground planes on appreciable areas of opposed faces of said base;

b. a helical resonator positioned in the vicinity of a first of said ground planes; and c. means for providing impedance matching between said helical resonator and an electrical circuit, comprising:

1. a microstrip transmission line formed by selected portions of the second of said ground planes;

2. means electrically interconnecting a first terminal of said helical resonator, a first terminal of said circuit, and a first electrical end of said microstrip transmission line;

3. means electrically interconnecting a second terminal of said helical resonator, a second terminal of said circuit, and a second electrical end of said microstrip transmission line; and 4. said microstrip transmission line being of an electrical length less than one-quarter wavelength at the resonator frequency of said helical resonator for constituting an inductive impedance, and having overall dimensions and being of a configuration preselected in accordance with the thickness and dielectric constant of said insulative base to provide a predetermined inductive impedance value for said microstrip transmission line at the resonant frequency of said helical resonator whereby said impedance matching is attained.

6. The arrangement defined in claim 5, wherein said microstrip transmission line is elongated and is bent upon itself to conserve the space occupied thereby.

* * * * *